US005943933A

United States Patent [19]

Evans et al.

[11] Patent Number: 5,943,933

[45] Date of Patent: Aug. 31, 1999

[54] CUTTING MECHANISM

[76] Inventors: Murray Evans, 3093 Golden Orchard, Mississauga Ontario, Canada, L4X 2T9; Thomas Thomas, 83 Hemingford Place, Whitby Ontario, Canada, M1R 1G2

[21] Appl. No.: 08/899,056

[22] Filed: Jul. 23, 1997

Related U.S. Application Data

[63] Continuation of application No. 08/354,844, Aug. 9, 1994, abandoned.

[51] Int. Cl.[6] ..... B26D 7/27; B26D 7/02; B26D 3/06

[52] U.S. Cl. ..... 83/522.19; 83/917; 83/468.2; 83/468.7; 83/464; 83/268; 83/563; 83/636; 83/692; 83/455; 83/641; 83/633; 83/581; 83/875

[58] Field of Search ..... 83/917, 614, 613, 83/594, 581, 522.25, 522.19, 522.17, 522.16, 468.7, 468.6, 468.2, 468.1, 464, 268, 247, 633, 454, 455, 563, 636, 879, 875, 869, 692, 693, 641

[56] References Cited

U.S. PATENT DOCUMENTS

| | | | |
|---|---|---|---|
| 1,735,216 | 11/1929 | Sims | 83/522.17 X |
| 2,613,740 | 10/1952 | Drain | 83/633 |
| 2,837,160 | 6/1958 | Vera et al. | 83/917 X |
| 3,065,657 | 11/1962 | Thompson | 83/581 X |
| 3,120,143 | 2/1964 | Kreider | 83/581 X |
| 3,227,025 | 1/1966 | MacMillan | 83/917 X |
| 3,299,759 | 1/1967 | Johnson et al. | 83/917 X |
| 3,777,605 | 12/1973 | Spier | 83/917 |
| 3,812,753 | 5/1974 | Kiejzik | 83/917 X |
| 4,092,005 | 5/1978 | Benroth | 83/633 X |
| 4,111,088 | 9/1978 | Ziegelmeyer | 83/522.19 X |
| 4,193,331 | 3/1980 | Gathings | 83/581 |
| 4,194,422 | 3/1980 | Williams | 83/581 X |
| 4,567,802 | 2/1986 | Witherspoon | 83/581 |
| 4,638,698 | 1/1987 | Omholt | 83/581 |
| 4,930,384 | 6/1990 | Nakatsuji | 83/917 X |
| 4,970,925 | 11/1990 | Nakatsuji | 83/454 |
| 5,099,727 | 3/1992 | Kozyrski et al. | 83/464 |
| 5,125,307 | 6/1992 | Jackson | 83/633 |

FOREIGN PATENT DOCUMENTS

| | | | |
|---|---|---|---|
| 1372034 | of 1964 | France | 83/917 |

*Primary Examiner*—Rinaldi I. Rada
*Assistant Examiner*—Boyer Ashley
*Attorney, Agent, or Firm*—Donald E. Hewson

[57] ABSTRACT

A cutting mechanism for accurately cutting a notch in a piece of edging, to permit sharp bending of the piece of edging for a picture or plaque, is disclosed. The cutting mechanism comprises a jig secured to a base member, the jig being dimensioned to receive the piece of edging clamped thereto. A cutting blade is mounted on the base member for reciprocating movement between a first retracted position whereat the cutting blade is remote from the jig and a second fully extended position whereat the cutting edge has passed through the jig. The cutting blade has an inverted "V"-shaped cutting edge comprising two blade portions joined one to the other at a central vertex. A cutting blade guide means retains the cutting blade such that, during cutting of the piece of edging retained in place on the jig, the vertex is disposed at a level between the top surface of the jig and the top surface of the second wall of the piece of edging, so as to thereby permit scoring of the inwardly facing surface of the second wall of the piece of edging. A first blade receiving aperture is disposed in the jig to permit the cutting blade to pass therethrough, and is open at the top to permit the cutting blade to extend therethrough. An actuation handle permits selective movement of the cutting blade between the first retracted position and the fully extended position.

11 Claims, 6 Drawing Sheets

CUTTING MECHANISM

This is a Continuation of application Ser. No. 08/354,844 filed Aug. 9, 1994, now abandoned.

FIELD OF THE INVENTION

This invention relates to cutting devices and more particularly to cutting devices adapted to cut edging used as a border around wall mounted articles, such as pictures, plaques and the like.

BACKGROUND OF THE INVENTION

Cutting plastic or metal edging to go around wall mounted articles such as pictures, plaques, or the like, is well known. Such edging may be either "L"-shaped in cross-section—having a first wall and a second wall joined one to the other along a side edge of each—or may be "U"-shaped in cross-section—additionally having a third wall joined to said second wall along a side edge of each. Typically, for a rectangular wall mounted article, four appropriate length pieces of edging are cut at a 45° angle at each end of the four pieces. The four pieces of edging are secured together in any one of a variety of conventional manners so as to form the frame. The cutting operation is typically performed by a saw or a knife, with the piece of edging securely retained by a jig. Of course, if a plaque has more or fewer than four sides, then a corresponding number of pieces of edging can be used, with the ends of each of the pieces of edging being cut at a corresponding required angle.

Another way to place edging around a picture, plaque, or the like, is to use a piece of edging that is of sufficient length to encircle the entire perimeter of the plaque, and to bend the edging, as necessary, at three of the four corners of the picture, plaque, or the like. In order to bend plastic edging to fit properly onto a plaque it is necessary to cut notches into the walls of the edging—the first wall in the case of "L"-shaped edging and the first and third walls in the case of "U"-shaped edging. Each notch is defined by a pair of opposed edges converging one with the other so as to form a "V"-shape. In order to have properly fitting corners, it is important that each pair of opposed edges fit together properly such that there are no gaps between each pair of opposed edges and also that the walls of the edging do not overlap one another. It is therefore necessary to accurately cut each notch such that the two opposed edges that define the notch are oriented at an included angle of 90° with respect to each other. Only an extremely small error margin allowable. Further, each of these edges must be oriented at a 45° angle to the length of the piece of edging so that the lengths of the two opposed edges defining the notch are equal one to the other. Also, in the case of "U"-shaped edging, the two notches in each of the first and third walls at each corner must be angularly aligned one with the other and also linearly aligned one with the other in order to ensure that the corner can be properly formed when the piece of edging is bent into shape.

It is possible to form such notches by using a manually operable hand cutter; however, what typically results is that the edges of the notches are not oriented at a 45° angle with respect to the length of the piece of edging, nor are the notches in the first wall of the pieces of edging angularly or linearly aligned with the respective notches in the third wall. Also, it is quite slow to get the notches cut as accurately as possible by using a manually operable hand-held cutter that cuts one notch at a time. Indeed, it is not reasonable to expect to use a manually operable hand-held cutter even in a relatively low volume production environment.

Still another problem with forming a single piece of plastic edging around a plaque or the like, after the notches have been cut in the side walls of the piece of edging, is that the walls of the piece of edging are typically about 0.03 inches in thickness, or perhaps greater. Accordingly, the wall that is being bent tends to bend in the form of a small rounded corner having a radius curve, but does not form an abrupt corner. Rounded corners are unacceptable if a proper looking frame is to be formed around the picture or plaque. In order to create corners that are abruptly bent, and do not form a noticeable radius, the wall being bent should be scored on its inner surface in order to decrease the amount of material that has to be bent at that location.

Yet another problem with forming a frame from a single piece of edging is that the edges defining the notches in the two opposed walls of the material must meet properly one with the other. If these edges are cut at slightly more than an included angle of 90° with respect to each other, then a noticeable gap will result when the piece of edging is in place on the picture or plaque. If the angle between the two edges defining the notch is less than 90°, then the two portions of each side wall will either overlap which is unsightly, or will abut one to the other thus causing an angle of less than 90° to be formed. Typically what happens during cutting notches into the walls of plastic edging is that the plastic deforms slightly during cutting. If a 90° notch is to be cut—that is to say, a blade having a 90° angle is being used —then the notch ends up being about 91°, or so, thus causing a gap between the two opposed edges when the piece of edging is in place on the picture or plaque.

It is an object of the present invention to provide a cutting mechanism that cuts notches into both side walls of a "U"-shaped piece of plastic edging, with the notches being angularly and linearly aligned one to the other.

It is another object of the present invention to provide a cutting device that also accurately scores the wall that is being bent, of the "U"-shaped piece of plastic edging at the vertex of each notch.

It is yet another object of the present invention to provide a cutting device that accurately cuts notches in a "U"-shaped piece of plastic edging, which notches are defined by an included angle of 90°.

SUMMARY OF THE INVENTION

In a first embodiment of the present invention, there is provided a cutting mechanism for accurately cutting a notch through a first wall of a workpiece, and a co-operating score in a second wall of the workpiece. The cutting mechanism comprises a base member which defines a generally planar base surface. The base member has first and second jig members mounted thereon, which first and second jig members define a blade receiving aperture between them. The first and second jig members have respective first and second workpiece receiving surfaces, each disposed at a respective side of the blade receiving aperture; the respective first and second workpiece receiving surfaces being co-planar, and each of the first and second workpiece receiving surfaces is disposed in a first selected plane which is at a first selected distance from the base surface. The first and second jig members each have a front face which extends generally perpendicularly from the base surface to the first and second workpiece receiving surfaces, respectively. There is a workpiece clamping means mounted on the base member for clamping a workpiece against the first and second workpiece receiving surfaces of the first and second jig members, respectively. A cutting blade is provided, having an inverted "V" configuration. The inverted "V" configuration of the cutting blade has a vertex, and the vertex of the inverted "V" configuration of the cutting blade is disposed in a second selected plane which is spaced at a predetermined distance "S" from the first selected plane. The second selected plane defines the height of the blade with respect to the base surface; and the height of the blade receiving aperture with respect to the base surface is defined by the first selected distance, and is substantially the height of the blade. Thus, when the cutting blade is moved from the retracted position to the extended position thereof; the cutting blade passes through the blade receiving aperture between the first and second jig members, and the vertex of the cutting blade is moved in the second selected plane as the cutting blade is moved through the blade receiving aperture and through the first selected plane.

A further definition of the workpiece cutting device of the present invention is as follows: The workpiece cuting device comprises a base member which defines a generally planar base surface. A reciprocating cutting blade is provided, which is movably mounted on the generally planar base surface. There is an actuation means for reciprocating the blade in a first selected direction of reciprocation between a first retracted position and second extended position. The cutting blade defines an inverted "V"-shaped cross-section having a vertex, with the vertex being located at a first selected height relative to the generally planar base surface. There is also provided an elongated positioning jig having first and second faces which are disposed perpendicularly relative to the generally planar base surface, and mounted on the base member. The first and second faces of the elongated positioning jig are also disposed perpendicularly to the first selected direction of reciprocation of the cutting blade. The elongated positioning jig includes a workpiece receiving surface which is disposed between the first and second faces, and which is formed along the top thereof in a plane which is at a second selected height parallel to the generally planar base surface. The second selected height is substantially equal to, but is less than, the first selected height. The elongated positioning jig further includes a blade receiving aperture corresponding in dimension to the cross-section of the reciprocating cutting blade; the blade receiving aperture extends through the depth of the elongated positioning jig from the first face to the second face, in the first selected direction of reciprocation of the cutting blade.

BRIEF DESCRIPTION OF THE DRAWINGS

Embodiments of this invention will now be described by way of example in association with the accompanying drawings in which.

DETAILED DESCRIPTION OF THE PREFERRED EMBODIMENTS

Figure 1:
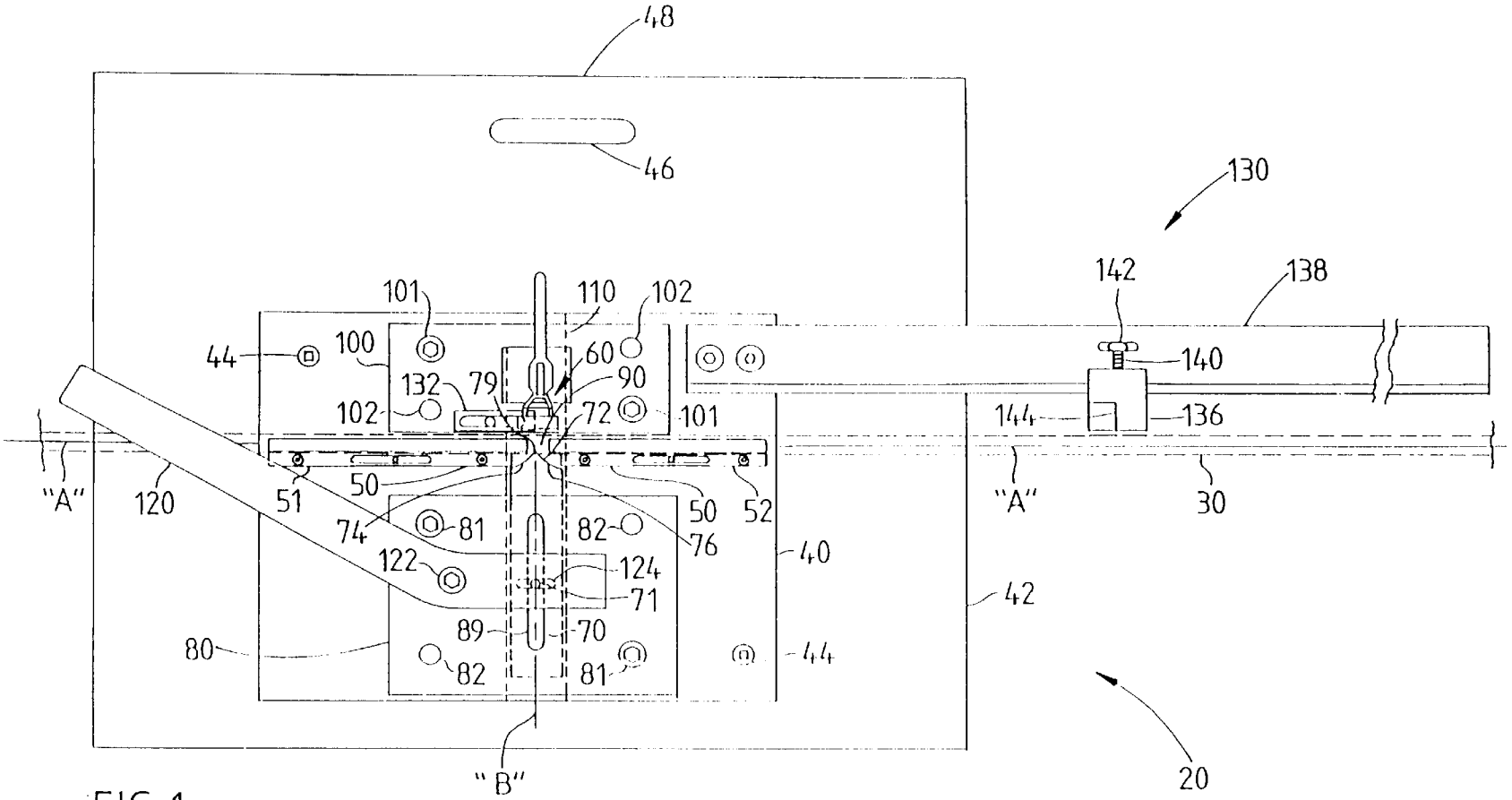
FIG. 1 is a top plan view of the cutting mechanism of the present invention.

Reference will now be made to FIGS. 1 through 6, which show the cutting mechanism 20 of the present invention, which is used for accurately cutting notches 34 and cooperating scores 35 in a piece of edging 30, and also to FIG. 7, which shows a piece of edging 30 that has been notched by the cutting mechanism 20. The notched and scored piece of edging 30 is suitable for placement around pictures, plaques, other types of wall hangings, display boards, signs, or most any relatively thin flat object to be displayed, and may be made from either plastic, metal, or other suitable materials, and may be either "L"-shaped in cross-section or may be "U"-shaped in cross-section. The "L"-shaped piece of edging is merely a subset of the "U"-shaped piece of edging. In this description of the preferred embodiment, a piece of edging 30 having a "U"-shaped crosssection will be described. The "U"-shaped piece of edging 30 has a first wall 31, a second wall 32 of thickness "T", and a third wall 33. The first wall 31 and the second wall 32 are joined one to the other along a side edge of each and the third wall 33 is joined to the second wall 32 along a side edge of each. Each of the first wall 31, the second wall 32, and the third wall 33, has a respective inwardly facing surface 31*i*, 32*i*, and 33*i*, and also has a respective outwardly facing surface 31*o*, 32*o*, and 33*o*. The piece of edging 30 is elongate along a first longitudinal axis "A".

The notches 34 are cut into the first wall 31 and the third wall 33 of the piece of edging 30, and the cooperating score 35 is cut into the inwardly facing surface 32*i* of the second wall 32, so as to permit sharp bending of the piece of edging 30, thus permitting the piece of edging 30 to conform properly to the corners of a picture or plaque, and so on.

The cutting mechanism 20 comprises a base member 40 that is preferably made from mild steel, but may be made from any suitable material. The base 40 is preferably of a rectangular shape, merely for ease of manufacturing, but may also be of any suitable shape. The base member 40 is mounted on a larger frame structure 42 by way of threaded fasteners 44. The frame structure 42 is preferably made of wood and is covered by a suitable outer laminate in order to preclude damage. An elongate aperture 46 is included adjacent one edge of the frame structure 42, so as to permit part of the frame structure 42 to act as a carrying handle 48, thus permitting the cutting mechanism 20 to be readily carried.

A jig member 50 comprises separate and distinct first and second portions 51, 52, and is of shape and dimensions to receive the piece of edging 30 thereon. Each of the first and second portions 51, 52 of the jig 50 is repositionable and is removably and replaceably secured to the base member 40, as will described in greater detail subsequently.

Figure 2:
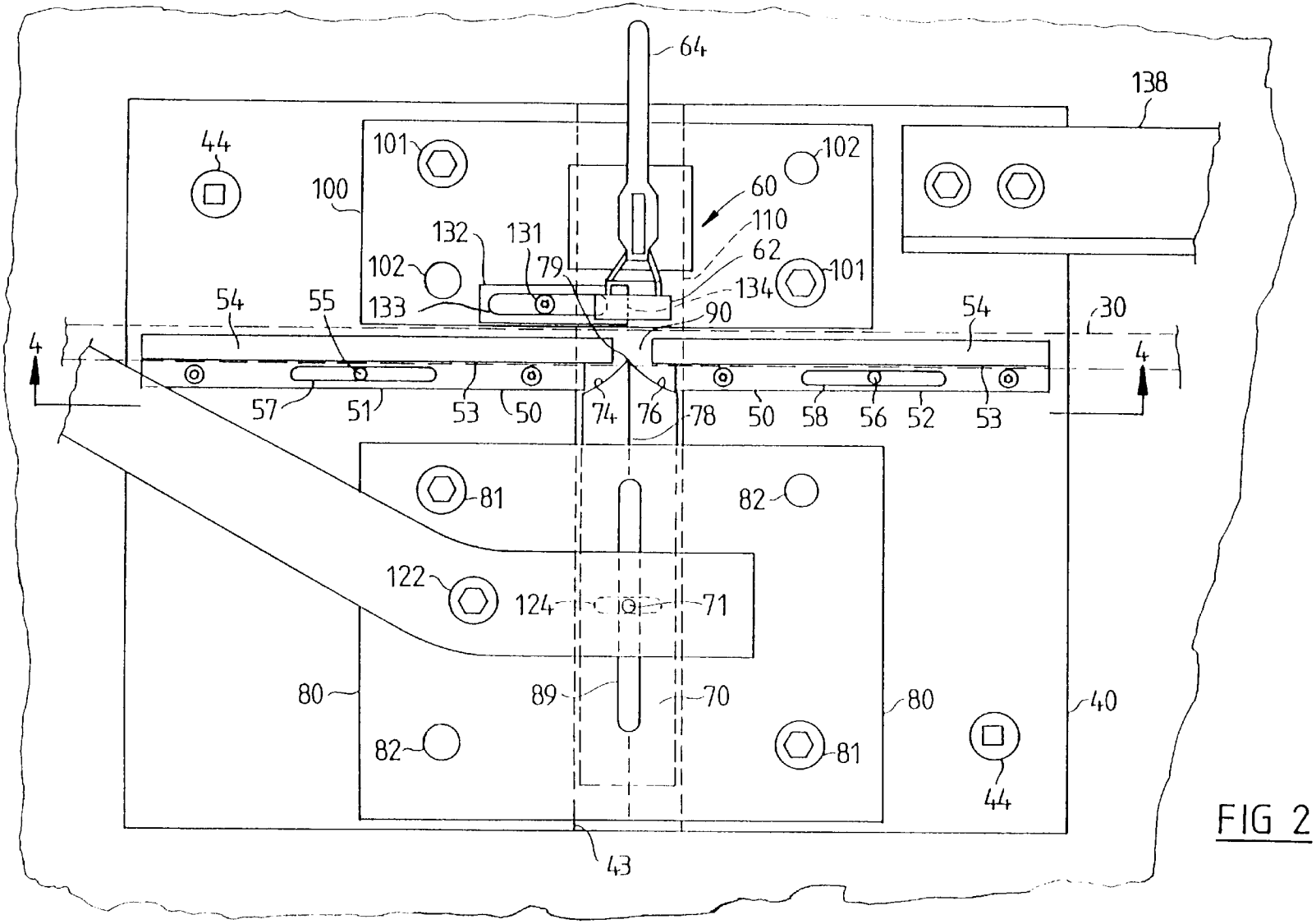
FIG. 2 is an enlarged top plan view of the cutting mechanism of FIG. 1.
Figure 3:
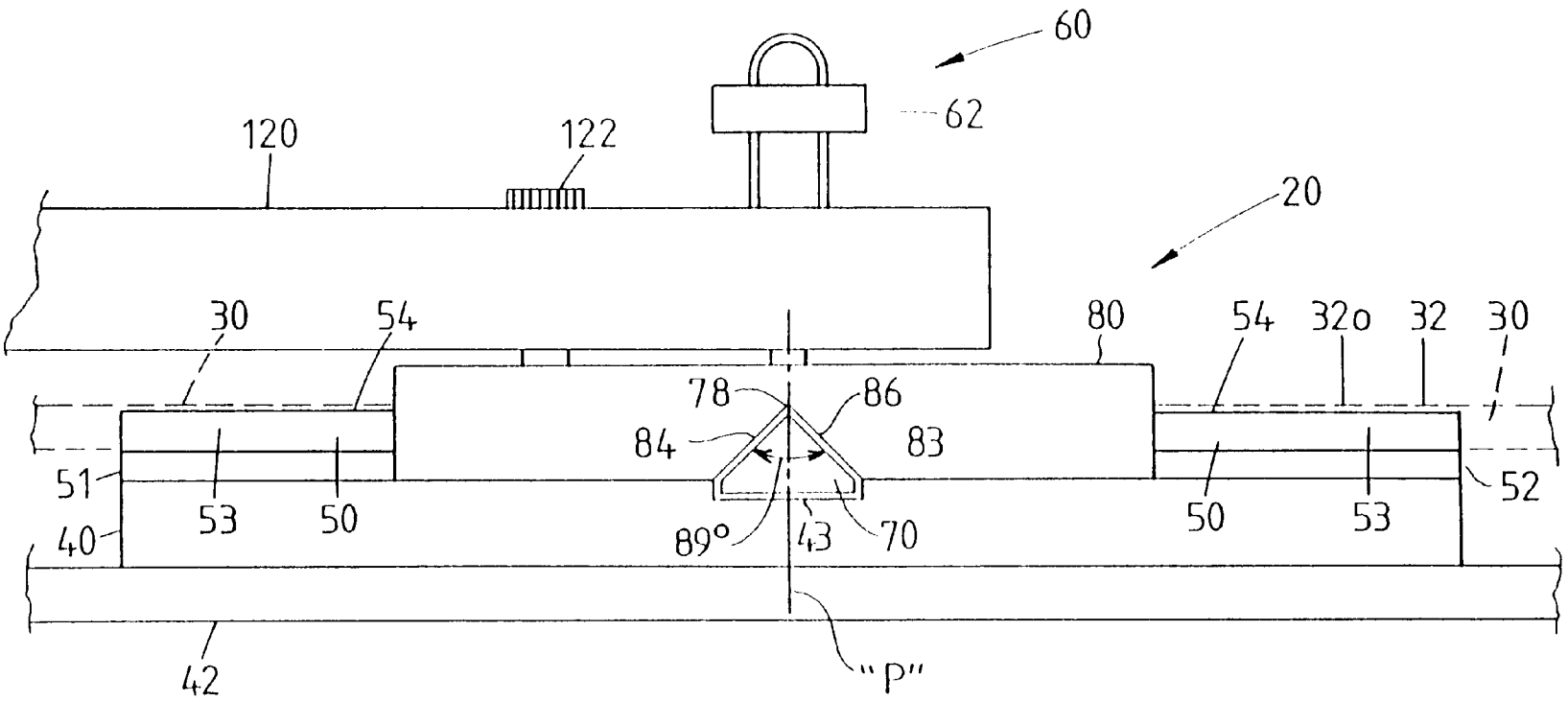
FIG. 3 is a front elevational view of the cutting mechanism of FIG. 1.
Figure 4:
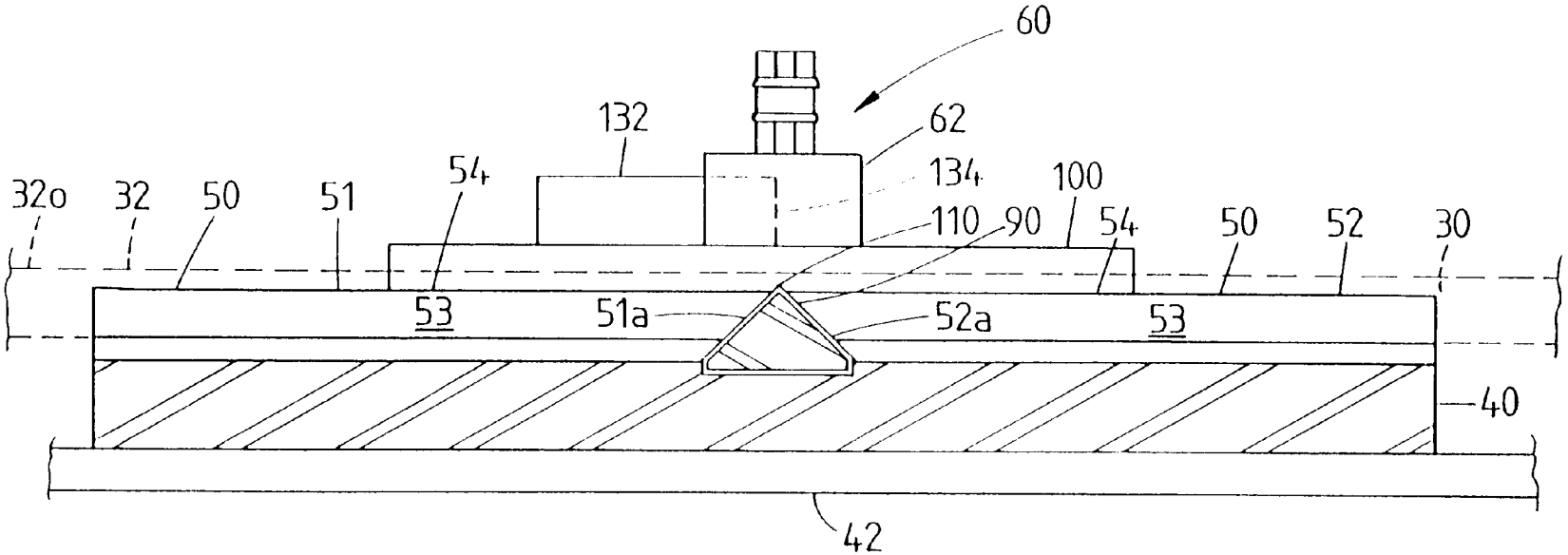
FIG. 4 is a cross-sectional view of the cutting mechanism of FIG. 1, taken along section lines 4—4 in FIG. 2 with the workpiece clamp shown in a clamping position.
Figure 5:
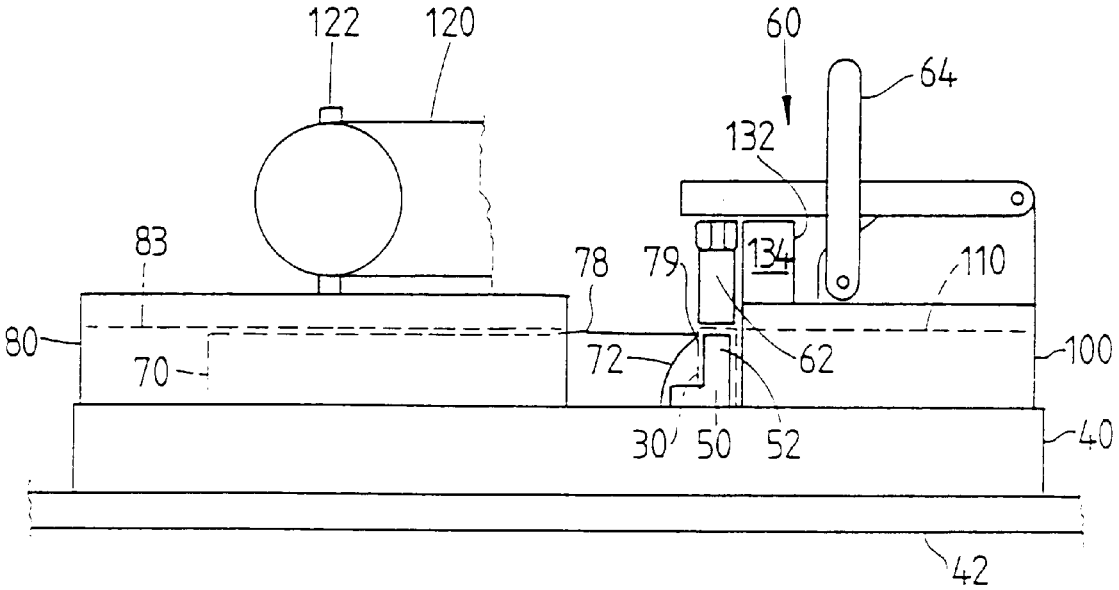
FIG. 5 is a side elevational view of the cutting mechanism, as shown in FIG. 4.
Figures 6, 7:
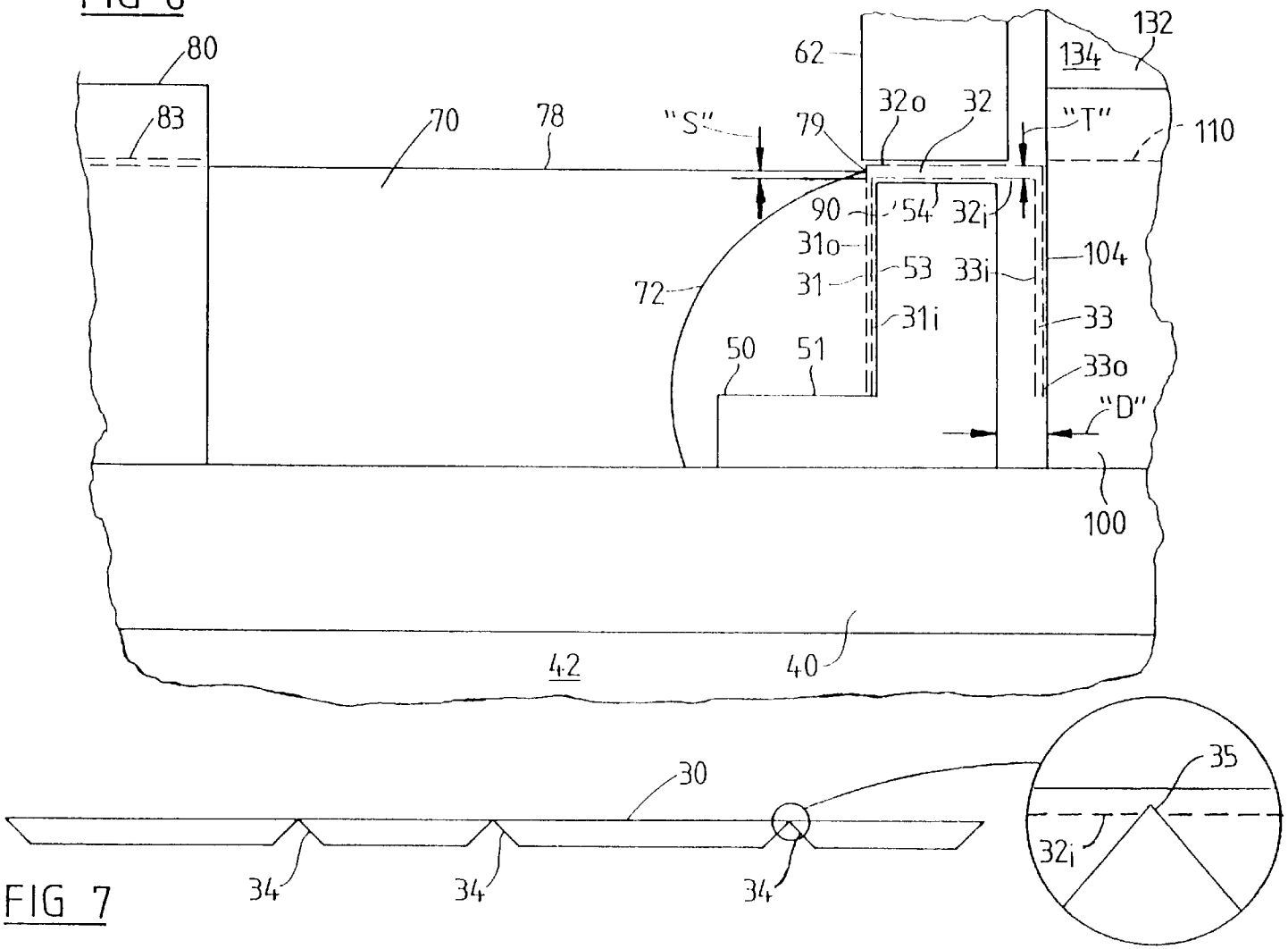
FIG. 6 is a greatly enlarged side elevational view of the cutting mechanism, as shown in FIG. 5.
FIG. 7 is a side elevational view of a piece of edging that has been notched by the cutting mechanism of the present invention.

A clamping means 60 is movable between a clamping position, as shown in FIGS. 4 through 6, whereat the piece of edging is clamped in place on the jig 50 and a releasing position, as shown in FIGS. 1 through 3, whereat the piece of edging is not clamped in place on the jig 50. The clamping means 60 may be a conventional clamp having a soft plastic head 62 to preclude marking of the piece of edging 30, and a manually operable handle 64. Operation of the handle 64 causes the head 62 to be moved between its clamping position and its releasing position.

The jig 50 has a first receiving surface 53 and a second receiving surface 54. The first receiving surface 53 is dimensioned to receive the inner surface 31*i* of the first wall 31 in other words, the first receiving surface 53 is virtually the same width as, or perhaps very slightly smaller than, the width of the inner surface 31*i* of the first wall 31. Similarly, the second receiving surface 54 is dimensioned to receive the inner surface 32*i* of the second wall 32. In this manner, the jig 50 is of shape and dimensions to receive the piece of edging 30 thereon, so as to support the piece of edging 30 during cutting of notches 34 and score 35 in the piece of edging 30. It is not necessary to have a third receiving surface on the jig 50 since a support surface 104 on a receiving block 100 receives the outer surface 33*o* of the third wall 33 during the cutting operation, as will be discussed in greater detail subsequently.

A cutting blade 70 is slidably mounted in a slot 43 in the base member 40 for reciprocating linear movement along a second longitudinal axis "B" between a first retracted position whereat the cutting blade 70 is remote from the jig 50, and therefore remote from the piece of edging 30, and a second fully extended position whereat the cutting edge 72 of the cutting blade has passed through the jig 50, and has therefore cut through the piece of edging 30, thus forming notches 34 and score 35. Preferably, the second longitudinal axis "B" is oriented in a direction substantially perpendicularly to the first longitudinal axis "A". The cutting blade 70 is slidably retained within a triangularly sectioned slot 83 in a housing block 80.

The triangularly sectioned slot 83 comprises two surfaces 84, 86 that are in close proximity to the cutting blade 70 so as to retain the cutting blade 70 in sliding relation along the second longitudinal axis "B", but so as to not be loose. Preferably, the clearance between each of the surfaces 84, 86 and the respective portion of the cutting blade 70 is about 0.002 inches so as to allow for easy sliding of the cutting blade within the triangularly sectioned slot 83, without the cutting blade 70 being loosely retained. Together, the slot 43 in the base member 40 and the slot 83 in the housing block 80 act as cutting blade guide means that accurately guide the cutting blade 70 in a straight path along the second longitudinal axis "B".

The housing block 80 is removably mounted on to the base member 40 by way of a pair of threaded fasteners 81. Alignment pins 82 are used to keep the housing block 80 precisely aligned in the base member 40.

The cutting blade 70 has an inverted "V"-shaped cutting edge 72, with the two sides of the "V" bisecting a central plane "P" oriented generally perpendicularly to the first longitudinal axis "A". The cutting edge 72 is generally in the shape of the notches 34 to be cut in the piece of edging 30. The inverted "V"-shaped cutting edge 72 comprises two curved leading edge portions 74, 76, with the included angle between the two blade portions 74, 76 being about 89°—in other words about 1° less than the 90° included angle of the notch being cut. The purpose for this is that when cutting plastic material, the plastic material tends to stretch slightly, and a cutting edge having a cutting angle of about 89° between the two blade portions 74, 76 produces notches having an included angle of about 90°.

In the preferred embodiment, the two curved leading edge portions 74, 76 are preferably mirror images of each other and are each in the form of a curved path, as can best be seen in FIG. 6. The circular cylinder shape actually defines the end surface of the cutting blade and is most easily formed using a circular cross-section cylindrical drill bit or the like. The two blade portions 74, 76 are joined one to the other at a central vertex 78, whereat the cutting edge 72 has a leading point 79. The two blade portions 74, 76 initially slope rearwardly while extending outwardly from the leading point 79 so as to provide a slicing function.

The housing block 80 retains the vertex 78 of the cutting blade 70, such that, during cutting of the piece of edging 30 that is retained in place on the jig 50, the vertex 78 is disposed at a level between the second receiving surface 54 of the jig 50 and the outer surface 32*o* of the second wall 32 of the piece of edging 30. This level is at a distance "S" above the second receiving surface 54 of the jig 50. As can be best seen in FIG. 6, the vertex 78 of the cutting blade 70 extends through the open top portion of the first blade receiving aperture 90 beyond the second receiving surface 54 of the jig 50 by the distance "S", so as to score the inner surface 32*i* of the second wall 32 at a depth of "S". The depth "S" is typically about 0.015 inches when cutting notches into a piece of plastic edging 30 having a second wall 32 thickness "T" of about 0.030 inches. It has been found that the ratio of the thickness "T" of the second wall 32 of the piece of edging 30 to the distance "S" ranges about 1.5 to 1 and about 4 to 1, depending on the type of material being cut and also on the thickness of the second wall 32 of the piece of edging 30. It can be seen that, in this manner, the cutting blade scores the inner surface 32*i* of the second wall 32 of the piece of edging 30 so as to permit the piece of edging 30 to be readily foldable into corners that are abrupt, and not significantly rounded, so as to fit properly to the corner of a picture or plaque.

A first blade receiving aperture 90 is disposed in the jig 50, and is shaped and dimensioned to permit the cutting blade 70 to pass therethrough. The size of the first blade receiving aperture 90 is determined by the positioning of the first and second portions 51, 52 of the jig 50. In the preferred embodiment, the first and second portions 51, 52 of the jig 50 should be positioned so as to define the size of the first blade receiving aperture 90 as slightly greater than the cross-section of the cutting blade 70, with the end surfaces 51*a*, 52*a* of the first and second portions 51, 52 of the jig 50 being disposed at a distance of about 0.002 inches from the respective surfaces of the cutting blade 70. In this manner, the first receiving surface 53 of the jig 50 is distanced from the location on the inner surface 31*i* of the first wall 31 of the piece of edging 30 where the cutting edge 72 of the cutting blade 70 will actually cut the first wall 31 by a distance of only 0.002 inches. Accordingly, the first receiving surface 53 supports the first wall of the piece of edging 30 in the area surrounding the cutting edge 72, when the cutting edge 72 is cutting through the first wall 31. Accordingly, the first wall 31 is precluded from significantly bending, as plastic material is inclined to do, thus permitting the notch 34 to be accurately cut into the first wall 31 and the score 35 to be accurately cut in the inwardly facing surface 32*i* of the second wall 32.

Each of the first and second portions 51, 52 of the jig 50 is adjustable in position with respect to the cutting blade 70 thereby permitting the size of the first blade receiving aperture 90 to be adjustable. The first and second portions 51, 52 of the jig 50 are mounted by way of threaded fastener means 55, 56, each extending through a respective elongate aperture 57, 58 in a corresponding one of the first and second portions 51, 52 of the jig 50, and threadibly engaging the base member 40.

A receiving block 100 is secured to the base member 40 on the opposite side of the jig from the housing block 80, by way of threaded fastening members 101 and alignment pins 102. The receiving block 100 has a support surface 104 disposed in opposed relation to the jig 50 at a distance "D" from the jig 50 to permit the third wall 33 of the piece of edging to fit between the support surface 104 and the jig 50, thereby to permit the third wall 33 to be supported by the support surface 104 during cutting of the third wall by the cutting blade 70. The distance "D" is preferably about 0.02 inches greater than the overall thickness of the third wall 33. A second blade receiving aperture 110 is disposed in the receiving block 100 with the second blade receiving aperture 110 being shaped and dimensioned similarly to the first receiving aperture 90, with the edges of the second blade receiving aperture 110 being disposed at a distance of about 0.002 inches from the surfaces of the cutting blade 70, to thereby permit the cutting blade 70 to enter into the second blade receiving aperture 110 and to permit the support surface 104 to support the third wall 33 of the piece of edging 30 in the area surrounding the cutting edge 78 when the cutting edge 78 is cutting through the third wall 33. It should be noted that the second blade receiving aperture 110 is formed all of the way through the receiving block 100 in the preferred embodiment; however, the second blade receiving aperture 110 need only be formed part of the way into the receiving block 100, to a depth that permits the cutting blade 70 to cut through the entire piece of edging 30.

An actuation means in the form of a manually operable handle member 120 is pivotally mounted on the base member 40 by way of a threaded fastener 122 engaged within the housing block 80. A pin member 71 extends upwardly from the cutting blade 70 through an opening 89 in the housing block 80 and engages an elongate slot 124 in the handle member 120. Pivotal movement of the handle member 120 causes corresponding linear movement of the cutting blade 70 along the second longitudinal axis "B". The handle member 120 permits movement of the cutting blade 70 between its first retracted position and its fully extended position.

The cutting mechanism 20 further comprises measurement means 130 operatively secured to the base member 40. The measurement means 130 comprises a first indexing member 132 operatively secured to the base member 40 adjacent the jig 50 by way of a threaded fastening member 131 extending through an elongate slot 133 in the first indexing member 132 for engagement in the receiving block 100. The first indexing member 132 is selectively positionable at any one of a plurality of positions. The first indexing member 132 has a first indexing surface 134 thereon, generally aligned with the central vertex 78 of the cutting blade 70 when the cutting blade 70 is in its fully extended position. In actuality, the first indexing surface 134 should be disposed so as to be slightly offset from the central vertax 78 towards the second indexing surface 144. In this manner, the notches 34 and serves 35 cut in the piece of material 30 are cut at a distance apart that is slightly greater than the respective dimension of the picture, thus accommodating the thickness of the second wall member 32 when the piece of edging 32 is bent. In order to accommodate second walls of different thickness, the exact position of the first indexing surface 134 is selectively adjustable by way of loosening the threaded fastening member 131, repositioning the first indexing member 132, and retightening the threaded fastening member 131.

A second indexing member 136 is operatively mounted onto the base member 40 by way of an elongate extension arm 138 secured to the base member 40 by way of a threaded fastening member 140 having a hand operable knob 142. The elongate extension arm 138 is situated generally adjacent to and disposed generally parallel to the piece of edging 30, when the piece of edging 30 is secured in place in the jig 50. The second indexing member 136 is operatively mounted in selectively positionable relation to the base member 40 remote from the cutting blade 70 and adjacent the piece of edging 30. The second indexing member 136 has a second indexing surface 144 generally facing the first indexing surface 134.

In use, the picture or plaque to be framed is placed with one corner thereof at the first indexing surface 134, and an adjacent corner disposed along the elongate extension arm 138. The second indexing member 136 is moved to that remote corner of the picture or plaque such that the second indexing surface 144 touches the edge of the picture or plaque. The second indexing member 136 is then secured in place by way of turning the knob 142 on the threaded fastening member 140. The first indexing member 132 and the second indexing member 136 must be offset from where the piece of edging 30 is located during cutting, so that they do not interfere with the locating of the piece of edging 30; however, the first indexing member 132 and the second indexing member 136 should be adjacent the piece of edging 30 so as to permit the first indexing surface 134 and the second indexing surface 144 to be as close as possible to the piece of edging 30, to thereby permit accurate registration of the end of the piece of edging 30 with the second indexing surface 144. When the end of the piece of edging 30 is registered with the second indexing surface 144, the piece of edging 30 can be clamped in place and a notch 34 can be cut in each of the first wall 31 and the third wall 33 and the score 35 is cut into the second wall 32. The piece of edging 30 is then released.

In addition to the second indexing member 136, there is preferably a similar third indexing member (not shown) that is selectively positionably on the elongate extension arm in the same manner as is the second indexing member 136. The third indexing member also has a third indexing surface thereon, which also faces the first indexing surface. The purpose of the third indexing member is register the length of the plaque or picture in a manner analogous to that described for the second indexing member 136, whereas the second indexing member 136 is used to register the width of the plaque or picture. Accordingly, the third indexing member should extend upwardly beyond the level of the second indexing member so as to allow the plaque or picture to extend between the third indexing member and the first indexing member 132 without the second indexing member 136 interfering with the placement of the picture or plaque. Of course, the first indexing member must be of a suitable size and of a suitable dimension to accommodate use with both the first indexing member 132 and the third indexing member.

In use, once the second indexing member 136 and the third indexing member have been secured in place along the elongate extension arm 138, the piece of edging 30 is secured in place such that the end of the piece of edging 30 is near the cutting blade 70 so that notches 34 can be cut in the first wall 31 and the third wall 33 near the end of the piece of edging 30 and score 35 can be cut into second wall 32. The piece of edging 30 is then parted at this first notch to define one end of the completed piece of edging 30 that will be placed around a picture or plaque. The piece of edging 30 is then released, and moved until the first end is in register with the second indexing surface 144 of the second indexing member 136, and is then clamped in place. Another set of notches 34 are cut in the first wall member 31 and the third wall member 33, together with cooperating score 35 into the second wall member 32. The piece of edging 30 is then released and moved until that second notch is in accurate register with the third indexing surface of the third indexing member. The piece of edging 30 is then clamped in place and a third pair of notches 34 is cut in the first wall 31 and the third wall 33, and the piece of edging is then released and moved so that the third notches 34 are in register with the second indexing surface 144 of the second indexing member 136. The piece of edging 30 in again clamped in place and a fourth set of notches 34 are cut into the first wall 31 and the third wall 33. The piece of edging 30 is then released and the fourth set of notches 34 are put in register with the third indexing surface of the third indexing member and a final fifth pair of notches 34 are cut in the first wall member 31 and the third wall member 33. The piece of edging 30 is then parted at this fifth pair of notches 34, so as to define a four segment piece of edging 30 with the remaining three pairs of notches 34 defining the four segments. In each case, of course, a cooperating score is cut into the second wall member 32 at the same time that notches 34 are cut in wall member 31 and 33. The completed piece of edging 30 can then be put in place around a picture, plaque, or the like, and can be secured as necessary, by conventional means.

It is also possible to use the cutting mechanism 20 of the present invention in an analogous manner to that described above with a piece of edging having an "L"-shaped cross-section, having a first wall and a second wall. The piece of edging is placed on the jig 50 such that the first wall is against the first receiving surface 53 of the jig 50 and the second wall is clamped in place on the second receiving surface 54 of the jig 50. The cutting blade 70 is then manipulated in a manner as described above so as to cut a notch in the first wall and so as to score the inner surface of the second wall of the piece of edging 30.

Other modifications and alterations may be used in the design and manufacture of the apparatus of the present invention without departing from the spirit and scope of the accompanying claims.

What is claimed is:

1. A cutting mechanism for accurately cutting a notch through a first wall of a workpiece, and a co-operating score in a second wall of the workpiece;

said cutting mechanism comprising:

a base member defining a generally planar base surface, and having first and second jig members mounted on the base surface such that respective base faces of the first and second jig members contact the base surface, in which said first and second jig members define a blade receiving aperture therebetween, said first and second jig members having respective first and second workpiece receiving surfaces opposite said respective base faces and each workpiece receiving surface disposed at a respective side of said blade receiving aperture, said first and second workpiece receiving surfaces being coplanar, and each of said first and second workpiece receiving surfaces being disposed in a first selected plane at a first selected distance from said base surface;

said first and second jig members each having a front face, an opposing back face, and opposing side faces all extending generally perpendicularly from said base surface to said first and second workpiece receiving surfaces, respectively;

workpiece clamping means mounted on said base member for clamping the workpiece against said first workpiece receiving surface of said first jig member and against said second workpiece receiving surface of said second jig member;

a cutting blade having an inverted "V" configuration, said inverted "V" configuration having a vertex, said vertex of said inverted "V" configuration of said cutting blade being disposed in a second selected plane which is spaced at a predetermined distance "S" from said first selected plane, wherein said second selected plane defines the height of said blade with respect to said base surface, and wherein the height of sad blade receiving aperature with respect to said base surface is defined by said first selected distance, and is substantially the height of said blade; and actuation means to permit selective movement of said cutting blade between a first, retracted position and a second, extended position;

whereby, when said cutting blade is moved from said retracted position to said extended position thereof, said cutting blade passes through said blade receiving aperture between said first and second jig members, and said vertex is moved in said second selected plane as said cutting blade is moved through said blade receiving aperture and through said first selected plane.

2. The cutting mechanism of claim 1, further comprising measurement means mounted onto said base member, said measurement means comprising a selectively positionable first indexing member mounted onto said base member adjacent said first and second jig members, said first indexing member having a first indexing surface thereon generally aligned with said vertex of said "V" shaped configuration of said cutting blade when said cutting blade is in its extended position, and a second indexing member mounted in selectively positionable relation to said base member remote from said cutting blade and adjacent the workpiece when the workpiece is secured in place, said second indexing member having a second indexing surface, in which the second indexing surface generally faces said first indexing surface.

3. The cutting mechanism of claim 1, wherein said cutting blade has a leading point at said vertex, and first and second cutting edges which slope away from said leading point in a direction away from said blade receiving aperture towards said first retracted position.

4. The cutting mechanism of claim 3, wherein said cutting blade is slidably mounted in a slot in said base member, wherein said cutting blade is slidably retained within a triangularly sectioned slot in a housing block removably secured to said base member, and wherein said slot in said base member and said triangularly sectioned slot in said housing block act as cutting blade guide means.

5. A workpiece cutting device comprising:

a base member defining a generally planar base surface;

a reciprocating cutting blade movably mounted on said generally planar base surface;

actuation means for reciprocating said blade in a first selected direction of reciprocation between a first retracted position and a second extended position, said cutting blade defining an inverted "V" shaped cross-section having a vertex, said vertex being located at a first selected height relative to said generally planar base surface; and an elongated positioning jig having first, second, third and forth opposing side faces disposed perpendicularly relative to said generally planar base surface, said elongated positioning jig being mounted on said base surface such that a base face of the elongated positioning jig contacts the base surface, said opposing side faces of said elongated positioning jig being disposed perpendicularly to said first selected direction of reciprocation of said cutting blade, said elongated positioning jig including a workpiece receiving surface opposite said base face, said workpiece receiving surface being disposed between said opposing side faces and formed along a top thereof in a plane at a second selected height parallel to said generally planar base surface, said opposing side faces all extending from said base surface to said workpiece receiving surface, wherein said second selected height is substantially equal to but less than said first selected height;

said elongated positioning jig including a blade receiving aperture corresponding in dimension to the cross-section of said reciprocating cutting blade, said blade receiving aperture extending through the depth of said elongated positioning jig from said first face to said second face in said first selected direction.

6. The workpiece cutting device of claim 5, further comprising workpiece clamping means mounted on said base member for clamping a workpiece against said workpiece receiving surface of said elongated positioning jig.

7. The workpiece cutting mechanism of claim 5, wherein said cutting blade has a leading point at said vertex, and first and second cutting edges sloping away from said leading point in a direction away from said blade receiving aperture towards said first retracted position.

8. The workpiece cutting mechanism of claim 5, wherein said blade receiving aperture is a triangularly sectioned slot in a housing block removably secured to said base member, and wherein said housing block acts as a cutting blade guide.

9. The cutting mechanism of claim 5, further comprising measurement means mounted onto said base member, said measurement means comprising a selectively positionable first an indexing member mounted onto said base member adjacent said elongated positioning jig, said first indexing member having a first indexing surface thereon generally aligned with said vertex of said "V" shaped cross-section of said cutting blade when said cutting blade is in its extended position, and a second indexing member mounted in selectively positionable relation to said base member remote from said cutting blade, said second indexing member having a second indexing surface, in which the second indexing surface generally faces said first indexing surface.

10. In combination:

a workpiece; and a cutting mechanism for accurately cutting a notch through a first wall of the workpiece, and a co-operating score in a second wall of the workpiece;

said cutting mechanism comprising:

a base member defining a generally planar base surface, and having first and second jig members mounted on the base surface such that respective base faces of the first and second jig members contact the base surface, in which said first and second jig members define a blade receiving aperture therebetween, said first and second jig members having respective first and second workpiece receiving surface opposite said respective base faces and each workpiece receiving surface disposed at a respective side of said blade receiving aperture, said first and second workpiece receiving surfaces being coplanar, and each of said first and second workpiece receiving surfaces being disposed in a first selected plane at a first selected distance from said base surface;

said first and second jig members each having a front face, an opposing back face, and opposing side faces all extending generally perpendicularly from said base surface to said first and second workpiece receiving surfaces, respectively;

workpiece clamping means mounted on said base member for clamping the workpiece against said first workpiece receiving surface of said first jig member and against said second workpiece receiving surface of said second jig member;

a cutting blade having an inverted "V" configuration, said inverted "V" configuration having a vertex, said vertex of said inverted "V" configuration of said cutting blade being disposed in a second selected plane which is spaced at a predetermined distance "S" from said first selected plane, wherein said second selected plane defines the height of said blade with respect to said base surface, and wherein the height of said blade receiving aperture with respect to said base surface is defined by said first selected distance, and is substantially the height of said blade; and actuation means to permit selective movement of said cutting blade between a first, retracted position and a second, extended position;

whereby, when said cutting blade is moved from said retracted position to said extended position thereof, said cutting blade passes through said blade receiving aperture between said first and second jig members, said vertex is moved in said second selected plane as said cutting blade is moved through said blade receiving aperture and through said first selected plane;

said workpiece being dimensioned to be received on said first and second coplanar workpiece receiving surfaces of said first and second jig members, respectively, said workpiece having a thickness greater than said predetermined distance "S".

11. In combination:

a workpiece; and a workpiece cutting device;

said workpiece cutting device comprising:

a base member defining a generally planar base surface;

a reciprocating cutting blade movably mounted on said generally planar base surface;

actuation means for reciprocating said blade in a first selected direction of reciprocation between a first retracted position and a second extended position, said cutting blade defining an inverted "V" shaped cross-section having a vertex, said vertex being located at a first selected height relative to said generally planar base surface; and an elongated positioning jig having first, second, third and forth opposing side faces disposed perpendicularly relative to said generally planar base surface, said elongated positioning jig being mounted on said base surface such that a base face of the elongated positioning jig contacts the base surface, said opposing side faces of said elongated positioning jig being disposed perpendicularly to said first selected direction of reciprocation of said cutting blade, said elongated positioning jig including a workpiece receiving surface opposite said base face, said workpiece receiving surface being disposed between said opposing side faces and formed along a top thereof in a plane at a second selected height parallel to said generally planar base surface, said opposing side faces all extending from said base surface to said workpiece receiving surface, wherein said second selected height is substantially equal to but less than said first selected height;

said elongated positioning jig including a blade receiving aperture corresponding in dimension to the cross-section of said reciprocating cutting blade, said blade receiving aperture extending through the depth of said elongated positioning jig from said first face to said second face in said first selected direction;

said workpiece being dimensioned to be received on said workpiece receiving surface of said elongated positions jig, said workpiece having a thickness greater than the difference between said first selected height and said second selected height.

* * * * *

UNITED STATES PATENT AND TRADEMARK OFFICE

CERTIFICATE OF CORRECTION

PATENT NO. : 5,943,933

DATED : Augusut 31, 1999

INVENTOR(S) :. Donald E. Hewson

It is certified that error appears in the above-identified patent and that said Letters Patent is hereby corrected as shown below:

On the Title page, item [76] Inventors should be changed to read –Murray Evans, 3093 Golden Orchard, Mississauga Ontario, Canada, L4X 2T9 --.

Signed and Sealed this

Ninth Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,943,933
DATED : August 31, 1999
INVENTOR(S) : Donald E. Hewson

It is certified that error appears in the above-identified patent and that said Letters Patent is hereby corrected as shown below:

Title page,
Item [76], Inventors, should be changed to read -- Murray Evans, 303 Golden Orchard, Mississauga Ontario, Canada, L4X 2T9 --.

Signed and Sealed this

Eighth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 5,943,933
DATED : August 31, 1999
INVENTOR(S) : Murray Evans

It is certified that error appears in the above-identified patent and that said Letters Patent is hereby corrected as shown below:

Title page,
Item [76], Inventors, should be changed to read -- Murray Evans, 303 Golden Orchard, Mississauga Ontario, Canada, L4X 2T9 --.

This certificate supersedes Certificate of Correction issued March 8, 2005.

Signed and Sealed this

Tenth Day of May, 2005

JON W. DUDAS
*Director of the United States Patent and Trademark Office*